US006302526B1

(12) United States Patent
Lin et al.

(10) Patent No.: US 6,302,526 B1
(45) Date of Patent: Oct. 16, 2001

(54) ELECTRODE TYPE PRINT HEAD FOR PRINTING APPARATUS AND METHOD OF MANUFACTURING THE SAME

(75) Inventors: Chen-Hua Lin; Ching-Yu Chou; Ji-Chen Wu; Fung-Ing Hsu, all of Hsinchu (TW)

(73) Assignee: WiserTek International Corp., Hsinchu (TW)

( * ) Notice: Subject to any disclaimer, the term of this patent is extended or adjusted under 35 U.S.C. 154(b) by 0 days.

(21) Appl. No.: 09/496,644

(22) Filed: Feb. 3, 2000

(51) Int. Cl.[7] ..... B41J 2/14; B41J 2/04; B41J 2/05; B41J 2/06

(52) U.S. Cl. ..... 347/48; 347/54; 347/67; 347/55

(58) Field of Search ..... 347/48, 55, 54, 347/57, 44, 47, 67

(56) References Cited

U.S. PATENT DOCUMENTS 4,333,086 * 6/1982 Ebi ..... 347/55
5,278,583 * 1/1994 Oda et al. ..... 347/55
6,079,813 * 6/2000 Tuli ..... 347/54

* cited by examiner

*Primary Examiner*—Thinh Nguyen
*Assistant Examiner*—Juanita Stephens
(74) *Attorney, Agent, or Firm*—Birch, Stewart, Kolasch & Birch, LLP

(57) ABSTRACT

This specification discloses an electrode type print head for the printing apparatus and the method for manufacturing the same. The print head is placed in the inkjet cartridge of an inkjet-printing device. The print head comprises a substrate and a flexible nozzle plate with an ink reservoir formed in between. The flexible nozzle plate is attached onto the substrate, and the electrode set of the flexible nozzle plate corresponds to that of the substrate. When currents of different polarities are provided thereon, an absorptive force is generated to pull the flexible nozzle plate closer to the substrate. A pushing force jets the ink out of the print head and onto a printing media to achieve the goal of inkjet printing.

8 Claims, 4 Drawing Sheets

ELECTRODE TYPE PRINT HEAD FOR PRINTING APPARATUS AND METHOD OF MANUFACTURING THE SAME

BACKGROUND OF THE INVENTION

1. Field of the Invention

The present invention relates to an electrode type print head for the printing apparatus and the method for manufacturing the same and, in particular, to an electrode type print head manufactured by tape automated bonding for the application in the inkjet cartridge of an inkjet-printing apparatus. The print head jets the ink out onto a printing media to achieve the goal of inkjet printing.

2. Related Art

In an inkjet printer, the print head is placed at the ink outlet of the inkjet cartridge for jetting out ink for printing. In a typical heat bubble inkjet cartridge, the print head contains a thin film resistor. When the thin film resistor is heated, a small volume of ink droplet is rapidly vaporized and expanded to pass the ejection nozzle of the print head and to print a pattern of dots on a sheet of paper.

Please refer to FIGS. 1A to 1D, the print head comprises a heat bubble generator 1, an ink supply port 2, an ink passage 3, a movable plate 4, and a nozzle 5. The heat bubble generator generates bubbles 7. The ink supply port 2 connects to a larger ink reservoir (not shown) to obtain more ink 6. The nozzle 5 jets out the ink 6 to achieve the goal of inkjet printing. The ink passage provides a channel for the ink 6 to get to the nozzle 5 via the ink supply port 2. The movable plate 4 can be pushed by the bubble 7 generated by the heat bubble generator 1, and pushes the ink 6 so as to jet the ink 6 out of the nozzle 5.

FIG. 1 A shows a static structure of the print head. In FIG. 1B the heat bubble generator 1 creates a bubble 7 to push the movable plate 4. The movable plate 4 then pushes the ink 6 in the ink passage 3 so that some part of the ink 6 goes to the nozzle 5 due to the surface tension while the other part of the ink 6 generates circulation within the ink passage 3. FIG. 1C shows the expansion of the bubble 7. The ink 6 at the nozzle 5 conquers the surface tension due to the increasing pushing force from the bubble 7 and forms an ink droplet that is to depart from the nozzle 5. In FIG. 1D, the bubble 7 generated by the heat bubble generator 1 disappears and the movable plate 4 also returns to its original position. Therefore, the ink 6 at the nozzle 5 and near the ink supply port 2 returns to the movable plate 4, and the ink droplet leaves the print head. This thus completes the process of jetting the ink 6 out of the print head.

SUMMARY OF THE INVENTION

It is an object of the present invention to provide an electrode type print head for the printing apparatus. the print head being placed in the inkjet cartridge of an inkjet printing apparatus for jetting ink onto a printing media to achieve the goal of inkjet printing.

Another object of the present invention is to provide a method for manufacturing the electrode type print head.

Therefore. the electrode type print head for the printing apparatus disclosed in the present invention comprises a substrate and a flexible nozzle plate. The substrate is provided with a plurality of first electrode sets. The flexible nozzle plate is attached to the substrate and adjacent to a nozzle aperture formed at the position of each first electrode set on the substrate. A second electrode set is formed around each nozzle aperture. With currents of different polarities on the first electrode sets and the adjacent second electrode sets, the flexible nozzle plate generates deformation and jets out the ink flowing into the print head from the ink cartridge.

When the first electrode set has a positive current and the second electrode set have a negative current (i.e., when they have different polarities), then the absorptive force generated between them makes the flexible nozzle plate close to the substrate, which then pushes the ink out of the nozzle aperture to form an ink droplet and leave the nozzle aperture.

In addition, the method for manufacturing the electrode type print head including a substrate and a flexible nozzle plate with a plurality of nozzle apertures for the printing apparatus disclosed herein. It comprises the steps of forming a plurality of first electrode sets and corresponding second electrode sets on the substrate and the flexible nozzle plates, with each second electrode set being on the rim of the nozzle aperture of each flexible nozzle plate. The flexible nozzle plates then are attached onto the substrate so that each first electrode set keeps a proper distance from the corresponding second electrode set.

By following the above manufacturing method, one can obtain the electrode type print head structure. By controlling the first electrode sets and the second electrode sets with different polarities, one can further achieve the goal of inkjet printing.

The electrode type print head for the printing apparatus and the method for manufacturing the same disclosed in this specification achieve the following effect: A novel electrode type print head is provided. When first electrode sets and second electrode sets are provided with electrical signals, the flexible nozzle plate can be attracted to the substrate by the absorptive force generated from currents of different polarities. A pushing force can be generated to jet the ink out of the print head. Therefore, it is very suitable for the print head structure of an inkjet printing apparatus. Since the manufacturing method is easy, this print head possesses competitive superiority.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow by illustration only. and thus is not limitative of the present invention, and wherein.

DETAILED DESCRIPTION OF THE INVENTION

Figure 1A:
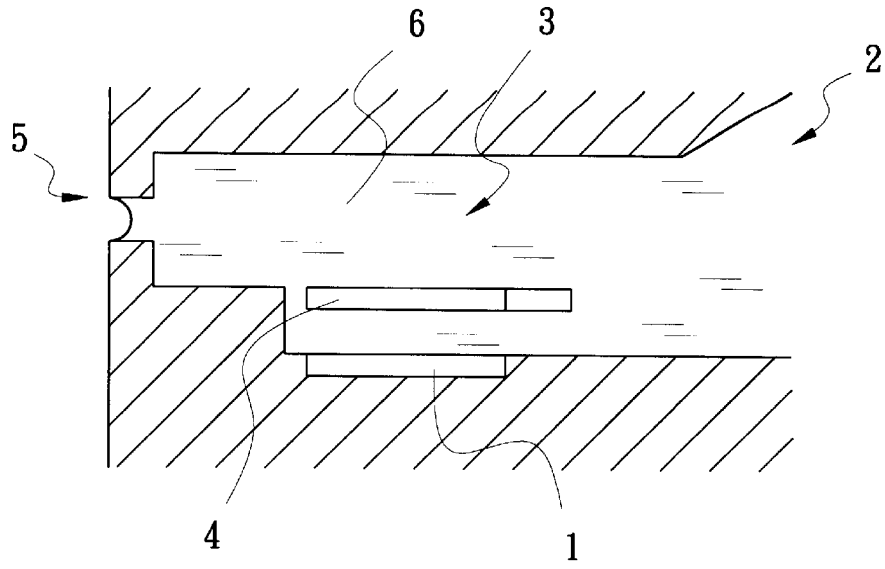
FIG. 1A (PRIOR ART)
FIGS. 1A through 1D are the schematic structure and actions of the print head in the prior art.
Figure 1B:
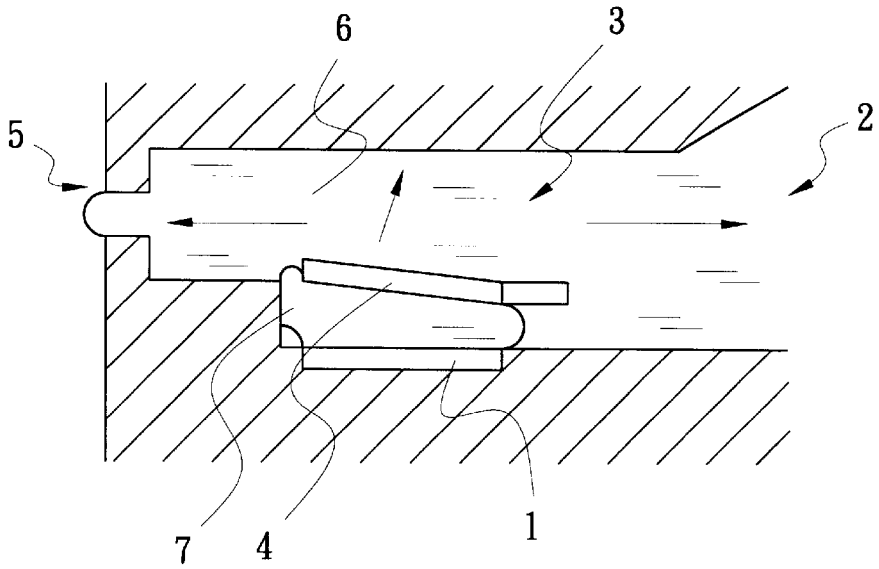
FIG. 1B (PRIOR ART)
Figure 1C:
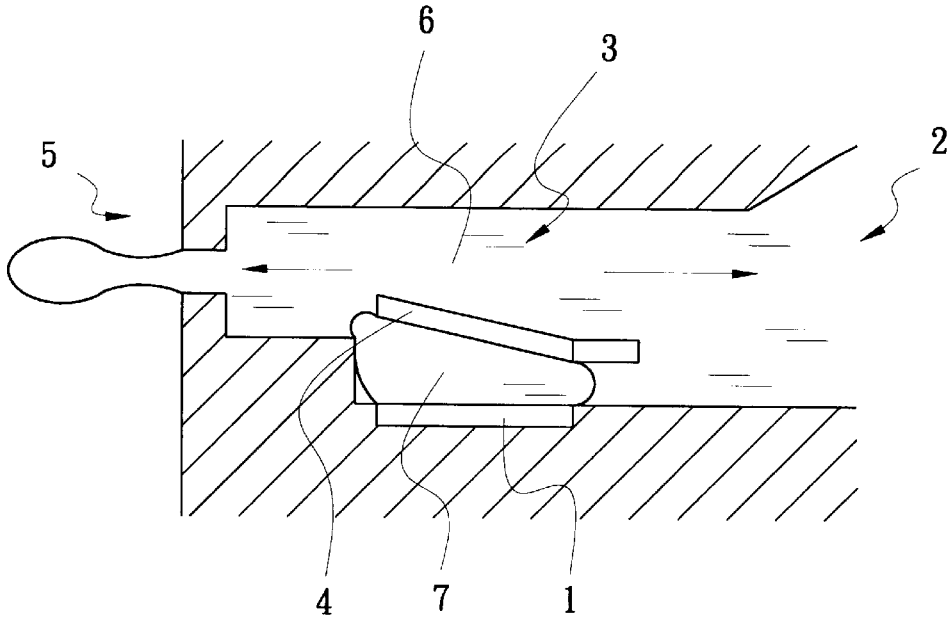
FIG. 1C (PRIOR ART)
Figure 1D:
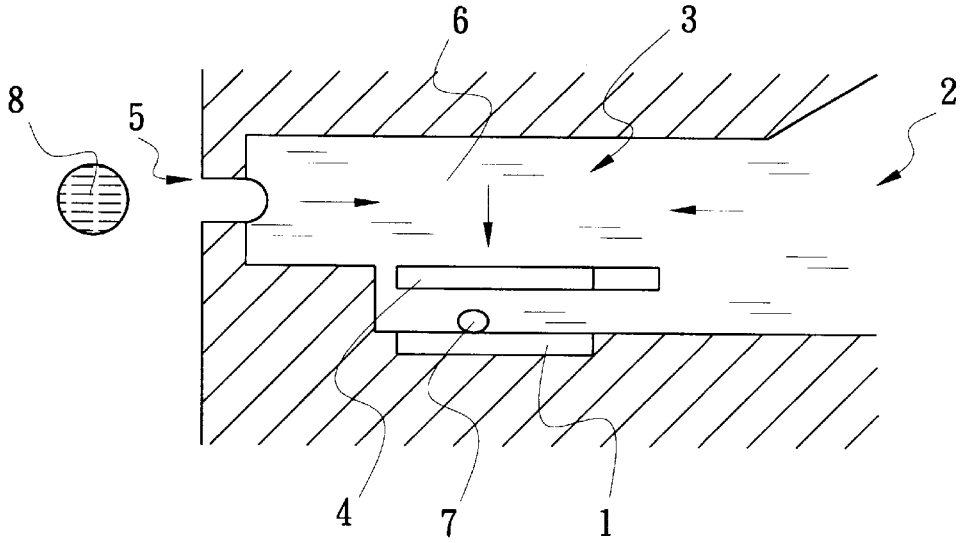
FIG. 1D (PRIOR ART)

The electrode type print head pursuant to the present invention for the printing apparatus is placed in the inkjet cartridge of an inkjet printing apparatus for jetting the ink flowing from the ink cartridge out of the print head and onto a printing media so as to achieve the goal of inkjet printing. Please refer to FIG. 2, which is a schematic view of the passage in the print head of the present invention. A flexible nozzle plate 20 in the upper portion of the drawing is provided with a plurality of nozzle apertures 21 for jetting ink. An ink passage 40 connects to the ink cartridge of a printing apparatus (now shown) and is provided with a plurality of ink chambers 41 for containing ink. The ink in the ink cartridge flows into the ink chambers 41 via the ink passage 40 and is jetted out through the nozzle apertures 21.

Figure 2:
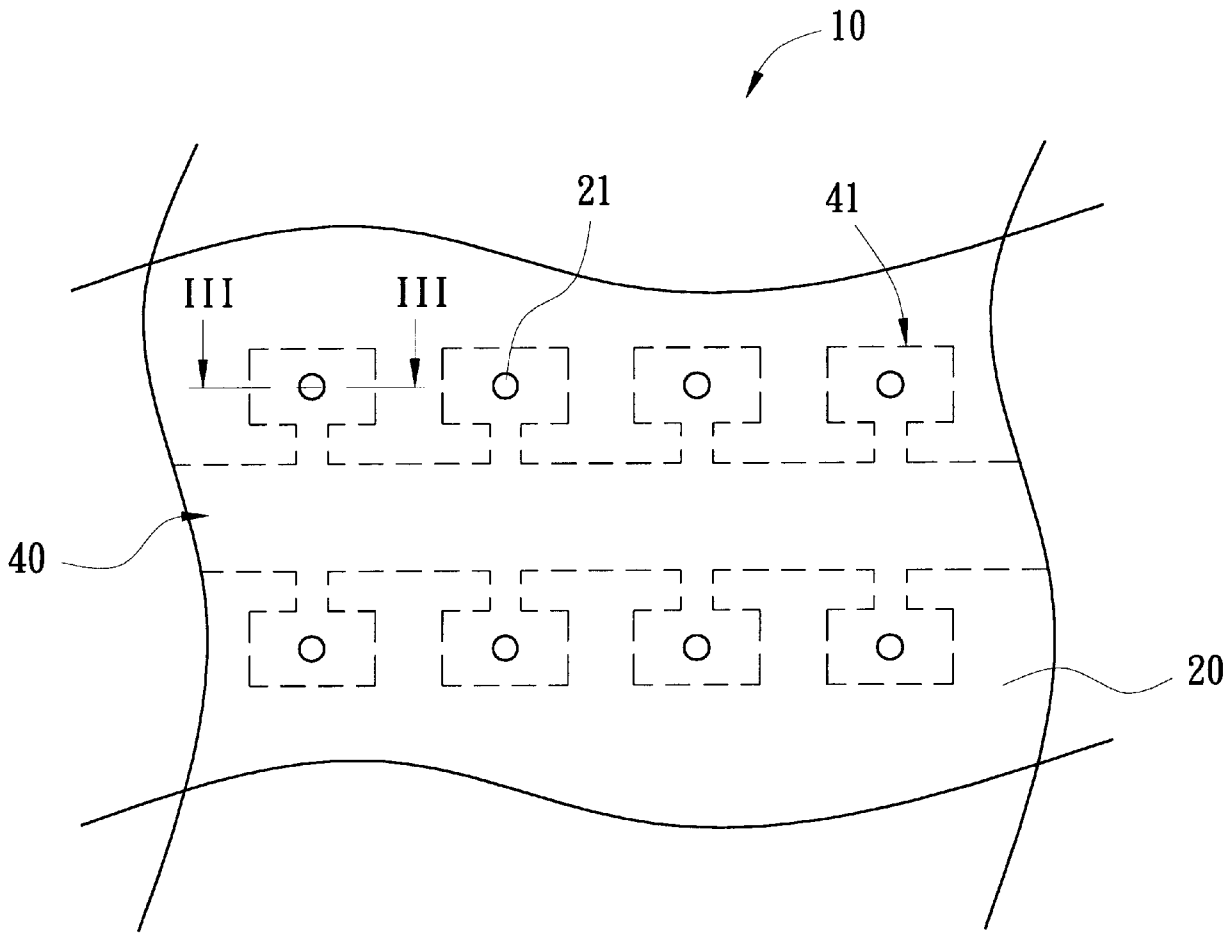
FIG. 2 is a schematic view of the passage in the print head of the present invention.
Figure 3:
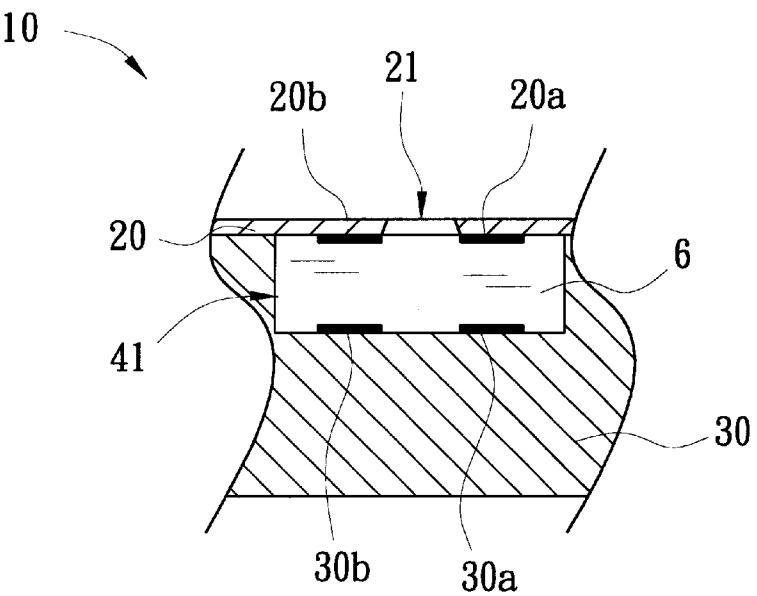
FIG. 3 is an III—III cross-sectional view of FIG. 2.

Please refer to FIG. 3, which is an III—III cross-sectional view of FIG. 2. An electrode type print head 10 comprises a substrate 30 and a flexible nozzle plate 20. The substrate is formed with a plurality of first electrode sets, each first electrode set containing at least one electrode. The first electrode set shown in the drawing contains two electrodes 30*a*, 30*b*, both connecting to a signal source (not shown) for obtaining a current with a positive or negative polarity. The material of the electrodes 30*a*, 30*b* is tantalum (Ta), which serves as both an IC electrode and a passivation layer.

The substrate 30 is provided with the space for the ink passage 40 and the ink chambers 41. The ink passage 40 connects to the ink cartridge of the printing apparatus as mentioned above to provide more ink 6 to flow into the ink chambers 41. The ink chamber 41 is a little space for accommodating a small quantity of ink 6 for jetting. The ink passage 40 and the ink chambers 41 are formed on the substrate 30 by providing several separators between the space for the ink passage 40 and the ink chambers 41. The flexible nozzle plate 20 is then attached onto the substrate 30, while each nozzle aperture 21 on the flexible nozzle plate 20 corresponds to each ink chamber 41. Thus, the ink 6 in the ink chamber 41 can be jetted out through the nozzle apertures 21.

The flexible nozzle plate 20 is an insulated flexible tape attaching onto the substrate 30. The electrodes 30*a*, 30*b* of the first electrode set on the flexible nozzle plate 20, which is adjacent to the substrate 30, are provided with nozzle apertures 21. Second electrode sets are formed around the rim of the nozzle apertures 21. Similarly, each second electrode set can further comprise at least one electrode, such as the second electrode set corresponding to the electrodes 30*a*, 30*b* of the first electrode set on the substrate 30 depicted in the drawing. The second electrode set comprises two electrodes 20*a*, 20*b*, and the electrodes 20*a*, 20*b* of the second electrode set correspond to the electrodes 30*a*, 30*b* of the first electrode set, respectively. Both electrodes 20*a*, 20*b* connect to a signal source (not shown) for an electrical current with a positive or negative polarity. The signal source connecting to the second electrode set can be different from that connecting to the first electrode, or both signal sources can be the same one for the convenience of the current polarity control between the first and the second electrode sets.

Figure 4:
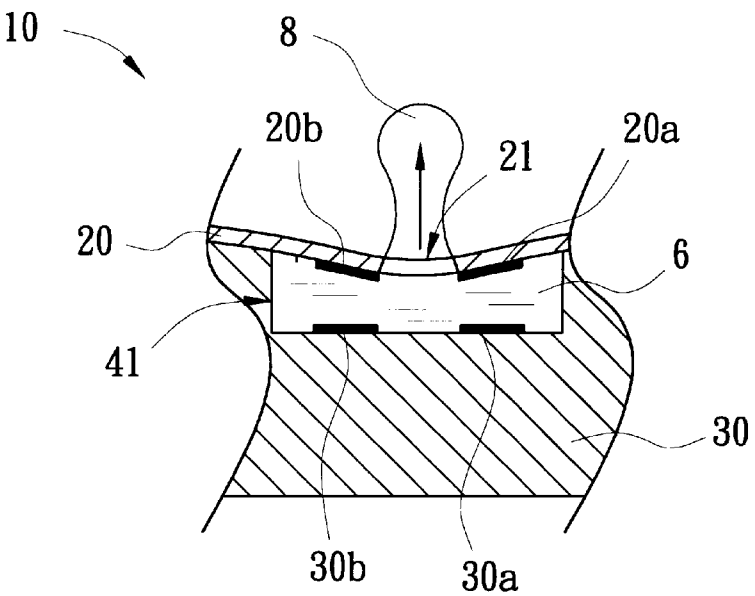
FIG. 4 is a schematic action plot of the print head of the present invention.

FIG. 4 is a schematic action plot of the print head 10 of the present invention. According to the structure of the aforementioned electrode type print head 10. the corresponding electrodes 20*a*–30*a*, 20*b*–30*b* formed by the electrodes 30*a*, 30*b* of the first electrode set and the electrodes 20*a*, 20*b* of the second electrode set on the flexible nozzle plate 20 are provided with electrical current signals with different polarities. For instance, the electrodes 30*a*, 30*b* of the first electrode set on the substrate are provided with a positive current. while the electrodes 20*a*, 20*b* of the second electrode set on the flexible nozzle plate a negative current. Because of the flexibility, the flexible nozzle plate 20 can be bent. Thus, the absorptive force generated from different polarities on the electrodes can deform the flexible nozzle plate 20 and make it closer to the substrate 30. The ink 6 in the ink chamber 41 close to the nozzle aperture 21 is squeezed out of the nozzle aperture 21 owing to the decreasing volume of the ink chamber 41 and forms an ink droplet 8, which is then jetted out for inkjet printing. In the meantime, the flexible nozzle plate 20 restores its shape after the deformation so that the ink 6 in the ink passage 40 returns to the ink chamber 41 near the nozzle aperture 21 for the next inkjet printing. Thus, repeated and continuous inkjet printing can be obtained.

Hereinbelow the manufacturing method of the electrode type print head 10 is explained. The method is to first provide a substrate 30 and form a flexible nozzle plate 20 with a plurality of nozzle apertures 21, where space is formed on the substrate 20 for an ink passage 40 and ink chambers 41 for the flow and refill of the ink 6. The method for forming the nozzle apertures 21 on the flexible nozzle plate 20 is to form a plurality of nozzle apertures 21 on the tape by laser piercing as inkjet outlets. The substrate 30 and the flexible nozzle plate 20 are formed with a plurality of corresponding first electrode sets and second electrode sets, respectively; each second electrode set is provided along the rim of the nozzle aperture 21 of the flexible nozzle plate 20. The substrate 30 and the flexible nozzle plate 20 are attached together so that each first electrode set keeps a proper distance from the corresponding second electrode set. In addition. in this manufacturing process, the nozzle apertures 21 can be first formed on the flexible nozzle plate 20 and the second electrode sets are then formed around the nozzle apertures 21 to provide the structure of the aforementioned electrode type print head 10.

The method for attaching the flexible nozzle plate 20 and the substrate 30 is achieved by tape automated bonding (TAB). TAB is a method that combines wireless bonding and continuous assembling of tape. which forms a finger-like conductor pattern on the punctuation portion repeatedly on the polymide tapeline. IC chips, LSI chips or bumps similar to chips are continuously formed on the pattern and overlap with the portions corresponding to the electrodes on semiconductor chips to form a soft circuit board. With a proper means, most wires can be connected. This connection can be simultaneous connections of a multitude of terminals to form multi-terminal connection or connecting terminals one by one to form single terminal connection. In addition to polymide resin, the material of the flexible nozzle plate 20 can be epoxy glass. BT resin or polyester thin films that are of the same effects.

The above manufacturing process of forming the flexible nozzle plate 20 using the flexible tape. attaching the flexible nozzle plate 20 to the substrate 30 with TAB, and providing a plurality of second electrode sets along the rims of the nozzle apertures 21 on the flexible nozzle plate 20 corresponding to a plurality of first electrode sets on the substrate 30 can be readily achieved in today's ordinary semiconductor manufacturing processes without extra cost for research and development or equipment. Therefore, this method has a superior potential and competitive power.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrode type print head for a printing apparatus that jets out ink flowing from an ink cartridge to the print head onto a printing media, comprising:

a substrate formed with a plurality of first electrode sets; and a flexible nozzle plate attaching onto the substrate, a nozzle aperture formed at each position adjacent to a first electrode set on the substrate and a second electrode set provided along a rim of each nozzle aperture, wherein currents with different polarities on the first electrode sets and the adjacent second electrode sets deform the flexible nozzle plate and jet out the ink flowing from the ink cartridge to the print head.

2. The electrode type print head according to claim 1, wherein an ink chamber for accommodating the ink is formed above each first electrode set on the substrate.

3. The electrode type print head according to claim 1, wherein the flexible nozzle plate is electrically insulated.

4. The electrode type print head according to claim 3, wherein the material of the flexible nozzle plate is selected from the groups consisting of polymide resin, epoxy glass, BT resin, and the polyester thin film.

5. The electrode type print head according to claim 1, wherein the material of the first electrode sets and the second electrode sets is tantalum (Ta).

6. The electrode type print head according to claim 1, wherein the first electrode set and the second electrode set comprise at least one electrode, respectively.

7. The electrode type print head according to claim 1, wherein the print head further comprises a signal source connecting to the first electrode sets and the second electrode sets.

8. The electrode type print head according to claim 1, wherein the first electrode sets are provided with a positive current and the corresponding second electrode sets with a negative current so that the first electrode sets and the second electrode sets create an absorptive force.

* * * * *